US006437300B1

(12) United States Patent
Katzman et al.

(10) Patent No.: US 6,437,300 B1
(45) Date of Patent: Aug. 20, 2002

(54) METHOD AND APPARATUS FOR COMPENSATING FOR VARYING WATER CONDUCTIVITY IN A DIRECT ELECTRODE WATER HEATING VAPORIZER

(75) Inventors: Richard Katzman, New York; Christopher S. Kanel, Hudson, both of NY (US); Robert Sherwood, El Paso, TX (US)

(73) Assignee: Kaz Incorporated, New York, NY (US)

( * ) Notice: Subject to any disclaimer, the term of this patent is extended or adjusted under 35 U.S.C. 154(b) by 0 days.

(21) Appl. No.: 09/727,362

(22) Filed: Nov. 30, 2000

(51) Int. Cl.[7] ..... H05B 1/02

(52) U.S. Cl. ..... 219/497; 219/501; 219/506; 392/318; 392/323

(58) Field of Search ..... 219/497, 499, 219/501, 506; 392/318–329

(56) References Cited

U.S. PATENT DOCUMENTS 4,132,883 A 1/1979 Grime
4,146,775 A * 3/1979 Kirchner et al. ..... 219/318
4,155,001 A 5/1979 Schossow
4,262,191 A * 4/1981 Lepper et al. ..... 219/497
4,288,684 A 9/1981 Katou et al.
4,343,987 A * 8/1982 Scimbke et al. ..... 219/486
4,692,591 A * 9/1987 Cooley et al. ..... 219/327

* cited by examiner

*Primary Examiner*—Mark Paschall
(74) *Attorney, Agent, or Firm*—Darby & Darby

(57) ABSTRACT

A vaporizer that adjusts to the conductivity of the water used in the vaporizer, and that also adjusts to changes in the conductivity of the water while in operation, thereby decreasing warm-up time and maintaining a relatively constant boiling rate and rate of steam production. The vaporizer includes hardware circuitry or other logic that maintains constant power supplied to the electrodes of the vaporizer to decrease warm-up time, and adjusts the current supplied to the electrodes while the vaporizer is in operation and after the warm-up period to maintain a relatively constant boiling rate and rate of steam production.

19 Claims, 3 Drawing Sheets

Conductivity 3200 $\mu$S

METHOD AND APPARATUS FOR COMPENSATING FOR VARYING WATER CONDUCTIVITY IN A DIRECT ELECTRODE WATER HEATING VAPORIZER

BACKGROUND OF THE INVENTION

1. Field of the Invention

The present invention relates to a vaporizer for adding moisture to the atmosphere in a room, and more particularly, to a vaporizer with control circuitry that allows for faster warm-up and that regulates the output of steam, regardless of the conductivity of the water in the vaporizer.

2. Discussion of Prior Art

Vaporizers are devices for generating steam, and serve as humidifiers by releasing steam into the atmosphere of a room, thereby adding moisture to the air. A common type of steam vaporizer is an electric vaporizer, which includes a pair of parallel electrodes, spaced apart and extended into water held in a reservoir. Electric current passes between the electrodes to heat the water sufficiently so that it creates steam. Typically, the electrodes are contained within a boiling chamber having a relatively small volume, such that the electrodes only need to heat the water within the boiling chamber, rather than the water in the entire reservoir. Examples of such prior art vaporizers are disclosed in U.S. Pat. Nos. 4,132,883, 4,288,684 and 4,155,001, all of which are expressly incorporated herein by reference.

Prior art vaporizers suffer from a number of shortcomings. Prior art vaporizers do not adjust to the conductivity of the water used in the vaporizer. This leads to variability in the amount of steam generated, depending on the type of water used. For example, the conductivity of different sources of water, such as tap water, can vary greatly. If the water is hard (i.e. contains a large amount of dissolved minerals), then the conductivity of the water will be high relative to water which is soft (i.e. contains a relatively small amount of dissolved minerals). Water of higher conductivity will boil too quickly, generating too much steam and ejecting hot water, whereas water of lower conductivity will generate too little steam.

Prior art vaporizers also do not take into account changes in the conductivity of the water during operation. The conductivity of water increases as it heats. Therefore the power level of the electrodes in prior art vaporizers starts low and only reaches the proper level after the water starts to boil. This leads to longer warm-up times.

Attempts have been made to correct for these faults. U.S. Pat. No. 4,155,001 (Schossow) discloses a device that attempts to control the amount of steam released through the use of an adjustable valve. However, this method is not very effective because the rate of production of steam is not actually controlled. Instead, the adjustable valve simply controls the size of the aperture that releases steam from the vaporizer. This arrangement only provides for coarse adjustment of steam release. Moreover, the Schossow reference does not teach a way of regulating the current of the electrodes, so that warm-up times are reduced and the rate of steam generated is maintained at a relatively constant rate despite changes in the conductivity of the water.

Accordingly, what is needed is a vaporizer that adjusts to the conductivity of the water in the vaporizer to decrease warm-up time and maintain a more constant boiling rate and constant discharge of steam.

SUMMARY OF THE INVENTION

The present invention is a vaporizer that adjusts to the conductivity of the water used in the vaporizer, and also adjusts to changes in the conductivity of the water while in operation, thereby decreasing warm-up time and maintaining a relatively constant boiling rate and rate of steam production. More particularly, the present invention is directed to a vaporizer with a hardware circuit or other logic means designed to maintain a relatively constant boiling rate and production of steam. The present invention includes a control circuit or other logic means that adjusts the current supplied to a pair of electrodes in a vaporizer in response to the conductivity of the water, thereby controlling the boiling rate of the water and, hence, the production of steam. The present invention also includes a method of maintaining a relatively constant boiling rate by adding a fixed amount of salt to water in a vaporizer to raise the conductivity of the water to a minimum level, using a circuit or other logic means to maintain the power supplied to the electrodes of the vaporizer at a relatively high level to increase warm-up time, and adjusting the current supplied to the electrodes while the vaporizer is in operation and after the warm-up time to maintain a relatively constant rate of steam production.

BRIEF DESCRIPTION OF THE DRAWINGS

The foregoing and other advantages and features of the invention will become more apparent from the detailed description of the preferred embodiments of the invention given below with reference to the accompanying drawings in which.

DETAILED DESCRIPTION OF THE PREFERRED EMBODIMENT(S)

The present invention includes both a method of, and apparatus for, maintaining a relatively constant rate of steam production in an electrode-type electric vaporizer.

Figure 1:
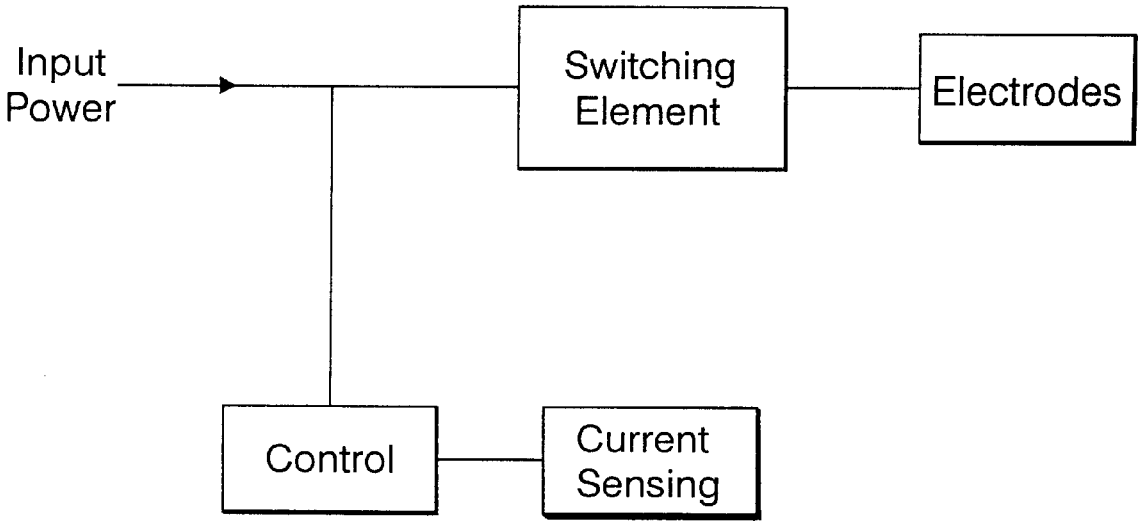
FIG. 1 is a block diagram demonstrating a general example of the invention.

FIG. 1 is a block diagram that demonstrates the general principles of the invention. One or more pair of electrodes are connected to a switching element, such as a triac or other device, which controls the flow of current to the electrodes. A control element, such as a programmable microprocessor or other logic device, controls the switching element to thereby adjust the flow of current to the electrodes. Current sensing elements, such as resistors and/or potentiometers, allow the control element to measure the relative amount of current flowing through the electrodes. The control element compares the measured value to a reference value; the reference value can be fixed or measured, and may or may not be user adjustable. The control element then adjusts the switching element to adjust the amount of current flowing to the electrodes. In a preferred embodiment, the control element adjusts the amount of current flowing to match the measured value to the reference value.

According to a more preferred embodiment of the method of the present invention, a fixed amount (e.g., 1 teaspoon) of common table salt or other electrolyte is added to water in a vaporizer to raise the conductivity of the water to a minimum level, e.g., approximately 3,200 microsiemens (uS), depending on the electrode spacing. Next, a microprocessor, or other logic device, is used to maintain the power supplied to the electrodes of the vaporizer at a relatively high level (e.g., approximately 300–400 watts) during the initial warm-up phase of the vaporizer (e.g., the first 30 to 60 seconds of operation). Finally, the microprocessor, or other logic device, is also used to adjust the current supplied to the electrodes while the vaporizer is in operation and after the warm-up time to maintain a relatively constant rate of steam production. Logic devices as used in the invention may include microprocessors, ASICs, and other types of hardware logic known in the art, as well as non-hardware logic such as software programs.

The control circuit or microprocessor provides gross and/or fine control in determining the appropriate power levels for the electrodes in the water. In one embodiment of the invention, the control circuit can operate with either 115 or 230 VAC conventional supply voltages. The circuit checks which operating voltage is being used and adjusts to provide a constant steam rate regardless of supply voltage. To help ensure that the rate of steam production is similar for the different voltages, the amount of power sent to the electrodes is kept relatively constant. This is achieved by regulating the timing of the circuit. For instance, if the voltage is 115, then a triac fires for both the positive and negative halves of the AC cycle, and if the voltage is 230, then the triac only fires during one half of the cycle. In doing so, the overall power output is roughly the same, regardless of the voltage used. This in turn helps to keep the amount of steam generated relatively constant, regardless of the supply voltage used by the vaporizer.

Figure 2:
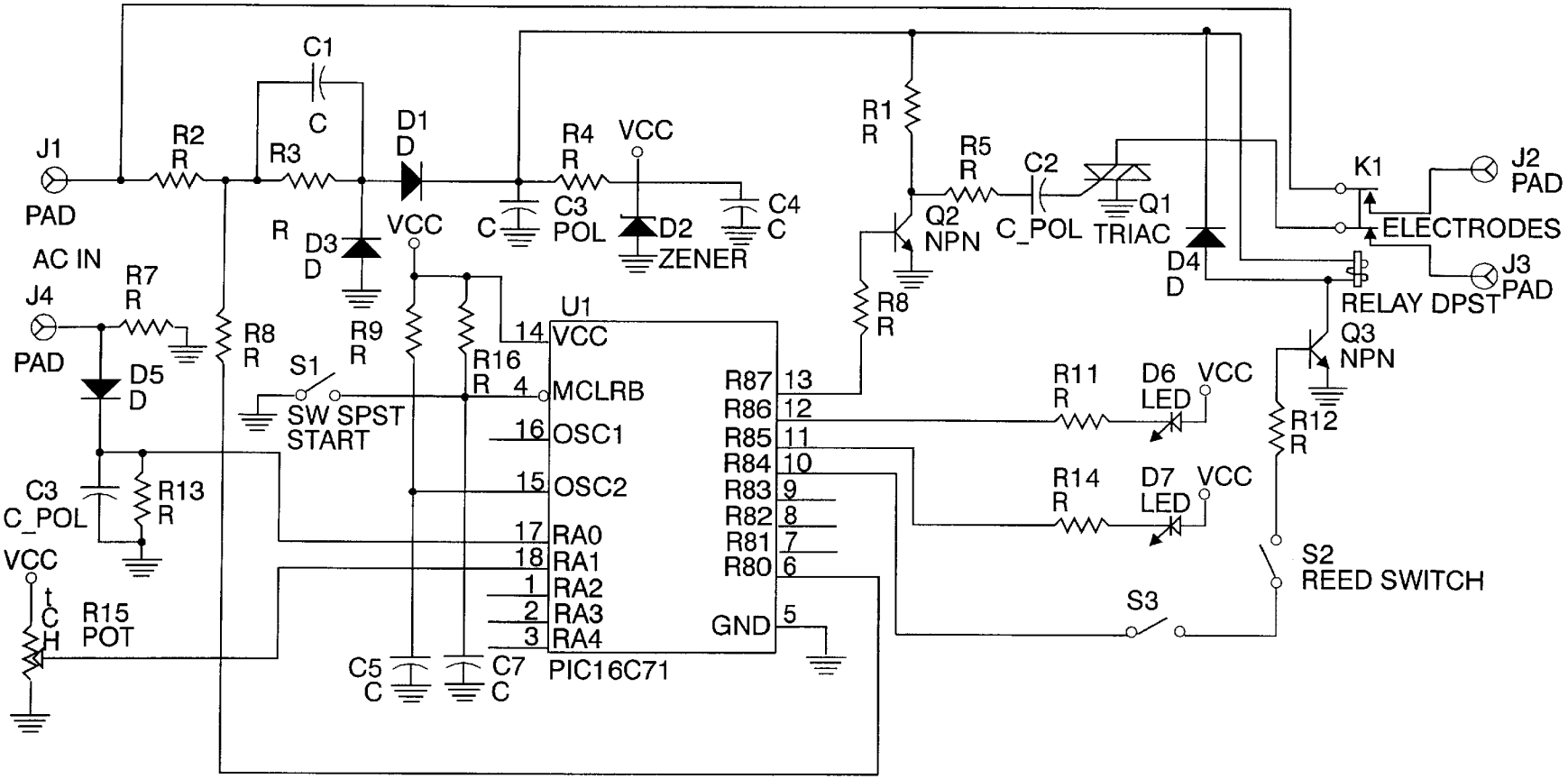
FIG. 2 is a schematic diagram of an exemplary circuit for use in a vaporizer according to the invention.

Fine control of the power and rate of steam production is achieved by measuring the voltage drop across resistor R7 as shown in FIG. 2, which represents a rough measure of the current flowing through the water. The voltage across R7 is measured during the negative half of the AC cycle, which is when the triac fires for both input AC voltage levels. The voltage drop across resistor R7 is then compared to the voltage drop measured at the wiper arm of a potentiometer, R15. In an embodiment of the invention, the resistance of potentiometer R15 is user adjustable; a knob, dial or other control device moves the wiper arm on the potentiometer, changing the resistance of R15 between a minimum and maximum value to thereby adjust the boiling rate. This user adjustable potentiometer is presented to the user as a "boiling rate setting".

A logic device, such as a programmed microprocessor, compares the voltage values measured at R7 and at the wiper arm of R1. In one embodiment, the analog voltage values measured at R7 and at the wiper arm of R15 are input into a microprocessor U1 that converts the analog values into eight-bit digital values. The digital value of the voltage measured at the wiper arm of R15 is used as a reference, and is compared to the digital value of the voltage across R7 to decide if the current is too high or too low. If the voltage across R7 is greater than the voltage measured at potentiometer R1, then the current is too high and the firing angle of the triac is adjusted to reduce the amount of current flow. If the voltage across R7 is less than the voltage measured at the wiper arm of R15, then the current is too low and the firing angle of the triac is adjusted so that it is closer to "zero" crossing, thereby increasing the current.

User adjustment of potentiometer R15 allows for adjustment of the current flow, and hence user adjustment of the boiling rate. If the wiper arm of potentiometer R15 is adjusted to decrease the voltage measured at R15, then the value measured at R7 becomes larger than R15. To compensate, the control circuit decreases the firing of the triac, lowering the current and thus decreasing the boiling rate of the water. Likewise, if the wiper arm of potentiometer R15 is adjusted to increase the voltage measured at R15, the voltage across R7 becomes smaller than the voltage at R15, thereby causing the control circuit to change the firing angle of the triac to increase the current flow and the boiling rate.

FIG. 2 is a schematic circuit diagram of the vaporizer control circuit according to the invention. DC power is derived from an AC voltage line using a capacitor C1, to obtain the voltage without creating an excessive amount of heat. Since the capacitor may be in a discharged state when the line cord is plugged in, resistor R2 is used to limit the peak current to a safe level until the capacitor charges.

Diodes D3 and D1 rectify the AC voltage and capacitor C3 filters the rectified voltage to provide 24 volts DC for a double pole relay K1 and a triac firing circuit. Resistor R4, diode D2, and capacitor C4 provide a 5 volt DC supply for the logic circuitry. The voltage drop across resistor R7 is a measure of the input current flowing from the AC voltage line, the vast majority of which is the electrode current and is in effect used to determine the electrode or water current, disregarding the minor amount of current consumed by the remaining circuitry. Diode D5, resistor R13 and capacitor C5 measure the current during the negative half cycle and provide a DC voltage that is proportional to the average AC current in the negative half cycle. The negative half cycle is selected because current is flowing during this time for both 115 and 230 volt supplies.

The voltage drop measured at resistor R7 is input to a microprocessor U1, where it is converted by an A-to-D converter into an eight-bit digital value. This value is compared to a digitally converted value of the measured voltage drop measured at the wiper arm of potentiometer R15, corresponding to the desired boiling rate. If the voltage measured across R7 is below the value of the voltage measured at the wiper arm of R15, i.e., the current is too low, the firing of the triac is moved closer to the zero crossing time of the AC line voltage. If the voltage across R7 is above the voltage set by R15, the microprocessor adjusts the firing angle away from the AC zero crossing to reduce the current. The voltage across R7 is also compared to a fixed value to determine if the water level is low. If the voltage falls below the fixed value (i.e., the current falls below a certain minimum value), then the water level is determined to be low and an LED, D6 is illuminated, power is removed from the relay and triac firing ceases.

Resistor R10 and capacitor C7 insure that the microprocessor is reset when power is applied. Switch S1, which is under user control, also resets the microprocessor and starts the operating sequence. Resistor R9 and capacitor C6 are used to set the clock frequency of the internal oscillator of the microprocessor U1. Diode D6, the refill LED, is activated by the microprocessor to indicate a low water level condition when the current is below a preset value as measured by the voltage drop across resistor R7. Diode D7 is activated by the microprocessor when the water conductivity is acceptable after the warm-up period, and flashes if the conductivity is too low.

The amount of current flowing through the water is a measure of the water conductivity; however, the conductivity of water changes as it is heated and its temperature increases. The only point at which the water is at a known temperature is when it is boiling. The present invention includes a circuit that checks the amount of current flowing after a predetermined warm-up period. If the current is too low, Diode D7 flashes and power is removed from the electrodes. If the water conductivity is above the acceptable limit, diode D7 stays on and does not flash.

Transistor Q2 and associated circuitry drive a triac Q1 to provide power to the electrodes through the double pole relay K1. Relay K1 is energized by current passing through a toggle switch located on the front panel (not shown) to transistor Q3 and associated circuitry. A toggle switch can be used in place of two magnetically operated reed switches in series which open when the electronics unit is separated from the magnet secured to the boiling chamber, e.g., when cleaning the electrode. The double pole relay K1 is used to disconnect both sides of the AC voltage line from the electrodes. The relay K1 is driven by microprocessor U1 through two reed switches, S2, S3, which are closed by the presence of a magnetic field (not shown). By mounting magnets in a part of the vaporizer housing containing the electrodes, adjacent to the electronics housing containing the relay K1, the power to the relay is removed when the housings are separated. The microprocessor U1 also removes power from the relay. As a result, an additional level of protection is provided.

In the circuit as shown in FIG. 2, a large, high power rated 1 ohm resistor which dissipates up to 16 watts is used as the current sensor R7. However, this also necessitates the use of a fan in order to cool the unit. Because the resistance of resistor R7 is small relative to the resistance of the water, the resistance of R7 can be reduced in value to lessen power dissipation by R7. However, the resulting smaller voltage measured across R7 must be amplified before being input into microprocessor U1.

The above method of sensing current and reducing the power level until a reasonable level of steam is obtained prevents sputtering and the boiling away of water too quickly. However, conductivity of water increases as it is heated such that without control circuitry the power level into the boiling chamber would start low and only reach the proper level after the water starts to boil, increasing warm-up time. The control circuitry of the present invention compensates for the initial low conductivity of water by setting the power level at a relatively high level when the vaporizer begins operation. This heats the water faster and decreases the time delay between the start of operation and the production of steam.

Figure 3:
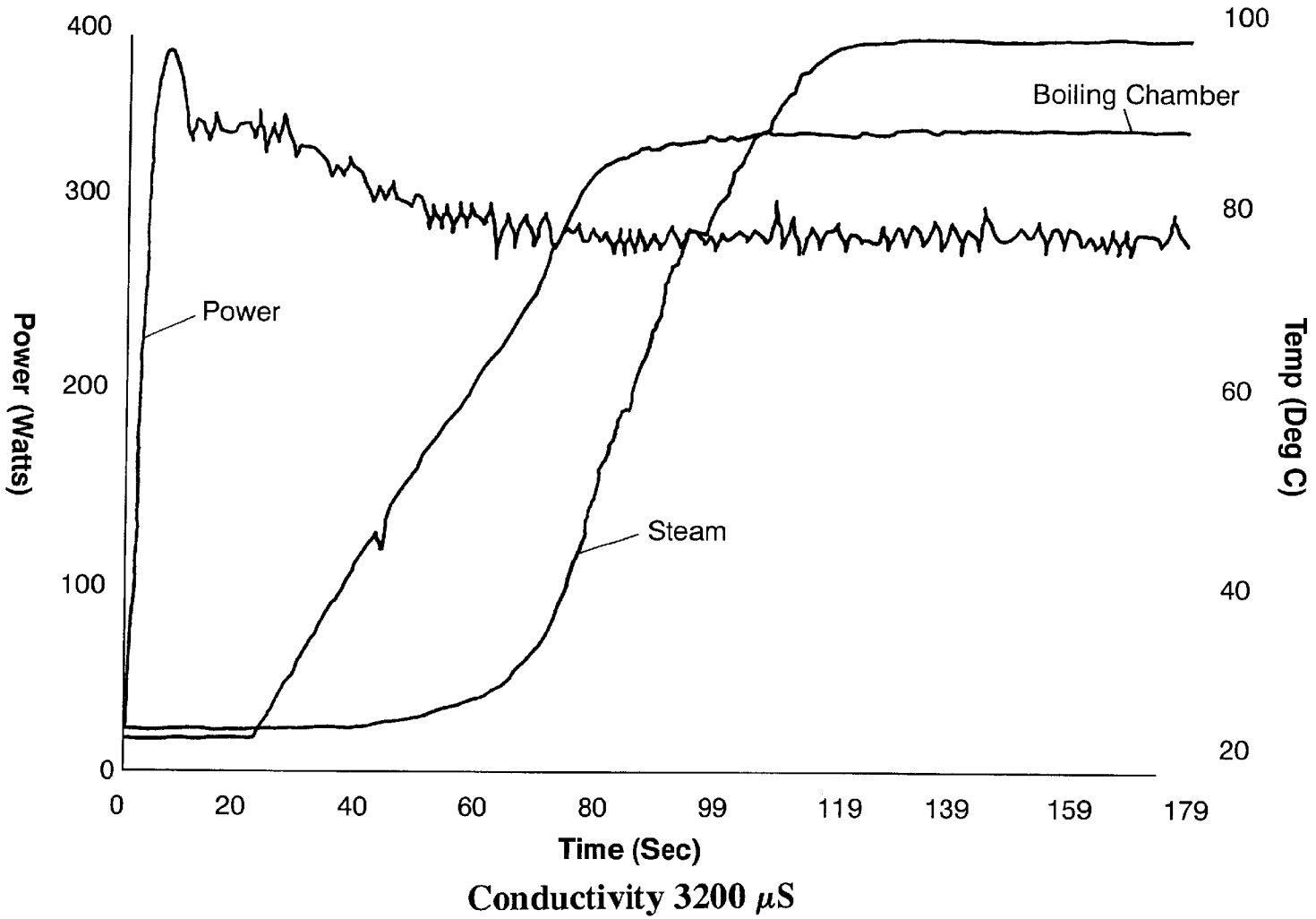
FIG. 3 is a graph of power, water temperature and air temperature as a function of time (in seconds) during, and after, the warm-up phase of a vaporizer that includes the control circuit of the present invention.

FIG. 3 is a graph of the warm-up time for a vaporizer with the control circuitry of the present invention. The power supplied to the electrodes is measured in watts as indicated on the left vertical axis. Temperature is measured in degrees as indicated on the right vertical axis. Time elapsed after the beginning of operation of the vaporizer is measured in seconds as indicated on the horizontal axis.

As shown in FIG. 3, the control circuitry initially sets the power at a relatively high level when the vaporizer begins operation. The graph line labeled "Power," which shows the power supplied to the electrodes, indicates that power is initially supplied at between 300 and 400 watts. The high power level ensures faster warm-up of the water, and faster production of steam. The circuit maintains this high power level during an initial warm-up period of 30 seconds. After the warm-up period, the circuit then begins normal operation, checking the amount of current flowing by measuring the voltage across R7. As indicated in FIG. 3, after approximately 30–60 seconds, the power supplied to the electrode falls as the triac firing adjusts to the correct power output based on the measurement of the voltage across R7 as compared to the voltage at the wiper of potentiometer R15. Thereafter, power is maintained at a relatively constant level. The graph also shows that as power reaches a constant level, water temperature, indicated by the line labeled "Boiling Chamber," reaches boiling after about 70 to 80 seconds of operation. The line labeled "Steam," which indicates the temperature of the air outside the steam vent port, shows full steam production some time after 100 seconds of operation.

In accordance with an embodiment of the present invention, a water reservoir of a vaporizer is filled and an amount of salt, e.g., 1 teaspoon, is added. Next, the mixture is stirred until the salt dissolves. The electrode assembly is then inserted into the water, and AC voltage is applied thereafter. At this point, switch S1 is pressed. If both reed switches S2 and S3 are closed, the microprocessor U1 will subsequently activate the triac Q1 and energize relay K1 in order to connect the AC voltage to the electrodes. Microprocessor U1 now immediately begins to monitor the low water level sensor, such that if the electrodes are removed from the water, the power is deactivated.

After a delay of, e.g., 30 seconds to allow the water to heat, the conductivity is checked and the LED flashes if the conductivity is too low. While the unit is operating, the operating current is monitored. If the current is too high, the firing angle of the triac Q1 is moved further from the zero crossing point of the AC waveform to reduce the current. If the current is too low the firing angle is moved closer to the zero crossing. If the current flowing is above the value set by potentiometer R15, LED D7 remains illuminated and the unit will operate until the low water level sensor turns it off. If the conductivity is too low, the power shuts off and LED D7 flashes. If at any time during operation the reed switches open, then power is immediately removed from the relay K1 and the low water level sensor deactivates the unit until the start switch S1 is pressed and the reed switches, S2 and S3, are closed.

If desired, relay K1 may be eliminated or only used in a version of the vaporizer which requires such isolation. The removal of power to the electrodes may be performed by a simple plug and socket system. Eliminating the relay K1 greatly simplifies the power supply, because the large current required by the relay is no longer needed.

Although the invention has been described and illustrated in detail, it is to be clearly understood that the same is by way of illustration and example, and is not to be taken by way of limitation. The spirit and scope of the present invention are to be limited only by the terms of the appended claims.

We claim:

1. A method for regulating the boiling rate of water contained in an electric vaporizer that utilizes a pair of electrodes immersed in said water, comprising the steps of:

generating an electric current between said pair of electrodes sufficient to boil said water, said generating step further comprising the step of supplying an increased level of current to said pair of electrodes for an initial period of time after the vaporizer is switched on to decrease warm-up time;

measuring the electric current between said pair of electrodes;

comparing said measured electric current to a reference value; and adjusting said electric current level supplied to said electrodes so that it matches said reference value.

2. The method of claim 1, wherein said reference value is user adjustable.

3. The method of claim 1, wherein the step of comparing is carried out by a programmed microprocessor.

4. The method of claim 1, wherein the step of measuring the electric current is carried out by measuring the voltage across a resistor connected to one or more of said pair of electrodes.

5. The method of claim 4, wherein said reference value is a voltage determined by measuring the voltage of a potentiometer.

6. The method of claim 5, wherein the step of comparing further comprises comparing the voltage measured at said resistor to the reference voltage measured at said potentiometer.

7. The method of claim 6, wherein the resistance of said potentiometer is user adjustable to allow for adjustment of the reference voltage measured at said potentiometer.

8. The method of claim 7 wherein the step of comparing is carried out by a programmed microprocessor.

9. A method for regulating the boiling rate of water contained in an electric vaporizer that utilizes one or more of a pair of electrodes immersed in said water, comprising the steps of:

generating an electric current between said pair of electrodes sufficient to boil said water;

measuring the electric current between said pair of electrodes;

comparing said measured electric current to a reference value, wherein said comparing step is carried out by a programmed logic device; and switchably energizing a switching element to adjust the electric current flowing to the pair of electrodes so that it matches said reference value.

10. The method of claim 9, wherein said reference value is user adjustable.

11. The method of claim 9, wherein the step of measuring the electric current is carried out by measuring the voltage across a resistor connected to one or more of said pair of electrodes.

12. The method of claim 11, wherein said reference value is a voltage determined by measuring the voltage of a potentiometer.

13. The method of claim 12, wherein the resistance of said potentiometer is user adjustable to allow for adjustment of the reference voltage measured at said potentiometer.

14. An apparatus for regulating the boiling rate of water contained in an electric vaporizer, comprising:

at least one pair of electrodes in contact with said water;

a resistor connected with one or more of said pair of electrodes, and having a resistor voltage indicative of a current through said electrodes;

a potentiometer for generating a reference voltage value;

a switching element for switchably energizing said electrodes; and a programmed logic device for comparing the resistor voltage to the reference voltage measured at the potentiometer, wherein said programmed logic device controls the switching of said switching element to thereby adjust the amount of electric current flowing to the pair of electrodes so that the measured voltage matches the reference voltage.

15. The apparatus of claim 14 wherein said programmed logic device includes a microprocessor, hardware logic or software.

16. The apparatus of claim 14 wherein said programmed logic device supplies an increased level of current to the pair of electrodes for an initial period of time after the vaporizer is switched on to decrease warm-up time.

17. An apparatus for regulating the boiling rate of water contained in an electric vaporizer, comprising:

at least one pair of electrodes in contact with said water;

a current sensing device connected with one or more of said pair of electrodes, for generating a value indicative of a current through said electrodes;

a switching element for switchably energizing said electrodes; and a programmed logic device for comparing the value generated by said current sensing device to a reference value, wherein said programmed logic device controls the switching of said switching element to thereby adjust the amount of electric current flowing to the pair of electrodes based on a comparison of the reference value to the value generated by said current sensing device.

18. The apparatus of claim 17, wherein the reference value is user adjustable.

19. The apparatus of claim 17 wherein said programmed logic device includes a microprocessor, hardware logic or software.

* * * * *